United States Patent [19]

Meyerhoff et al.

[11] 4,346,845

[45] Aug. 31, 1982

[54] GAS BURNER

[75] Inventors: Alfred Meyerhoff, Hempfield Township, Westmoreland County; John C. Kastovich, Murrysville; James A. Richard, Monroeville, all of Pa.; Richard J. Vales, Elyria, Ohio

[73] Assignee: York-Luxaire, Inc., Elyria, Ohio

[21] Appl. No.: 175,973

[22] Filed: Aug. 7, 1980

[51] Int. Cl.[3] ..... F23D 15/00

[52] U.S. Cl. ..... 239/418; 431/354; 48/180 F

[58] Field of Search ..... 239/418, 566, 568, 597, 239/556, 557, 558, 559, 560; 431/354, 355, 343; 48/180 C, 180 F, 180 R

[56] References Cited

U.S. PATENT DOCUMENTS

| | | | |
|---|---|---|---|
| 3,192,989 | 7/1965 | Miller | 239/560 |
| 3,270,967 | 9/1966 | Westerman et al. | 239/560 |
| 3,285,317 | 11/1966 | Hine, Jr. et al. | 158/99 |
| 3,312,267 | 4/1967 | Passarello | 158/99 |
| 3,351,118 | 11/1967 | Ward | 48/180 F |
| 3,567,137 | 3/1971 | Cavestany et al. | 239/60 C |
| 3,874,839 | 4/1975 | Riehl | 431/354 |
| 4,118,175 | 10/1978 | Riehl | 431/354 |

*Primary Examiner*—James B. Marbert
*Attorney, Agent, or Firm*—Thomas B. Hunter

[57] ABSTRACT

A gas burner is provided with a shaped part at its upstream end for the admission of primary air and gas, the shaped part 24 being monolithic with the burner and having openings 34, 36 for the admission of primary air from above, and is downwardly open for admission of air from below, the part receiving a primary air shutter 52 which is generally cylindrical to fit in telescoping relation upon the burner end part 24, the shutter having a lower slot 56 to accommodate the seam 18 of the burner, and the shaped part having a downwardly open saddle 38 adapting the burner upstream end to be seated on a gas spud.

4 Claims, 6 Drawing Figures

GAS BURNER

CROSS-REFERENCE TO RELATED APPLICATION

U.S. Patent Application Ser. No. 175,972, filed Aug. 7, 1980 is a related application which teaches a particular construction of the main portion of a sheet metal tapered gas burner.

BACKGROUND OF THE INVENTION

This invention pertains to the art of construction of sheet metal gas burners and, in particular, to that part relating to the gas burner upstream end configuration for purposes of primary air inlet and air shuttering.

As noted in the cross-referenced related application, the heating capacity of different size gas-fired furnaces using heat exchanger assemblies of modular construction is common practice, with each module including a burner assembly. Since the amount of gas needed is a function of the number of heat exchanger modules used, the size of the manifold pipe bringing the gas to the burners varies accordingly. It is not uncommon to have the upstream end of the burners physically conform to the manifold pipe in its attachment. An example of this is shown in U.S. Pat. No. 3,567,137 in which the semicircular end of the gas burner fits on a diameter of the manifold pipe. Since the heat exchanger modules are identical and any given adequate burner design can be the same for each of these modules, it is desirable to standardize the upstream end of the burner rather than vary its size to conform to the particular size of the manifold pipe.

Another problem with certain manifold mounting designs for gas burners comes from the different types of furnaces in which the burners are used. For example, counterflow furnaces and outdoor-type furnaces typically have their gas inlet manifolds located near the floor mounting surface of the furnace. Since with some arrangements the burners must be removed by passing them underneath the manifold pipe, the burners strike the floor that the furnace is positioned on. Also, sometimes burner removal over the top of the manifolds is not feasible because of physical interference with the heat exchangers secondary air inlet. Thus, in some cases the entire manifold must be dismantled and disconnected from the gas supply line before the burners can be removed.

Another aspect of the design of the upstream mounting and air inlet end of a gas burner relates to the provision of sufficient primary air in order to achieve complete combustion. The amount of primary air entering a burner is a function of the primary air inlet design, the size of the upstream end, the type of gas used, the spud gas jet design and obstructions in the airflow path. Thus, even if the upstream end design promotes servicing and easy removal, consideration must also be given to the provision of an efficient primary air inlet arrangement and one which avoids turbulent flow. Although the arrangements taught in U.S. Pat. Nos. 3,312,267 and 3,270,967 appear to be advantageous with respect to mounting the upstream ends of their particular burner designs on gas spuds, as distinct from upon the manifold itself, each of these patents include inlet air shutter arrangements which may be likened to sharp-edged orifices and are considered disadvantageous in that respect. It is one aim of our invention to provide an arrangement in which the advantages of mounting upon a spud are obtained, but without the disadvantages resulting from the sharp-edged orifice arrangement.

In another burner design, specifically that disclosed in U.S. Pat. No. 3,285,317, the upstream end of the burner is funnel-shaped and thus advantageous with respect to efficient flow. However, since the particular gas spud nozzle designs differ in accordance with the type of gas used and the gas pressure is also different with different gases, the regions within which the injected gas and primary air mix will be different in relation to the spud exit with different gases. In the funnel-shaped inlet in the noted patent, control of the gas and air mixing process is limited because of the fixed location of the funnel. It is another aim of our arrangement to avoid this limitation.

Another aspect of the inlet end configuration arises in the connection with the burning of high-density propane gas. Burning of this gas often results in sonic resonance and an intolerable level of noise. If proper control of the gas and air proportions in the mixing location is possible, this noise can be tuned out by adjustment. Since by design the manifold pipe is located in the path of the airstream parallel to the burner's center line, air flow into the burner interior is obstructed to a degree by the manifold. Some relief to this obstruction is available with designs such as taught in U.S. Pat. Nos. 3,312,267 and 3,270,967 which provide air entrances at the bottom half of the burner inlet. These arrangements also include the sharp-edged orifice problems as noted before. Further, the designs are also believed to require an increased burner size which is disadvantageous with respect to material requirements. Another aim of our invention is to avoid the disadvantages inherent in such arrangements.

Axially adjustable air shutters for controlling the admission of primary air are shown in each of U.S. Pat. Nos. 4,118,175; 3,312,267 and 3,270,967. However, in each of these the disadvantages of the sharp-edged orifice problem are at least among those problems arising from their particular configurations.

In summary, it is our aim to provide a burner inlet end configuration and mounting arrangement, along with an air shutter construction, which is considered advantageous compared to the various designs noted heretofore, and is relatively inexpensive in cost of materials and fabrication and has satisfactory operating characteristics.

SUMMARY OF THE INVENTION

In accordance with the invention an upstream end of a tubular gas burner is provided with a configuration adapted to be supported from a gas spud projecting from the gas manifold, the configuration taking form in a shaped sheet metal part projecting upstream from the air inlet end of the gas burner, with the part being downwardly open from about the horizontal mid-plane of the air inlet end of the burner, the part also being open at its upstream end and having at least one opening in the walls forming each of the upper quadrants of the part for the admission of inlet air downwardly into said air inlet end of the burner, the extreme upstream end of the upper quadrant walls being crimped inwardly to form a downwardly-open saddle which is adapted to be received downwardly on the outer circumference of the gas spud, the part including a groove extending longitudinally along the top of the sheet metal part, this groove at its upstream end having a depth dimension relative to the diameter of the particular gas spud with which the gas burner is to be used to substantially axially align, in a vertical direction, the burner member with the outlet of the spud.

The primary air shutter which cooperates with the upstream end of the burner is of substantially uniform cylindrical shape throughout a major portion of its length so as to fit in telescoping relation on the substantially uniform diameter cylinder of the upstream portion of the length of the burner member, the shutter having a converging-tube-shaped entry at its upstream end and having a longitudinal slot along its bottom to receive therein the rib along the bottom of the uniform diameter cylinder of the gas burner member.

DESCRIPTION OF THE PREFERRED EMBODIMENTS

Figure 2:
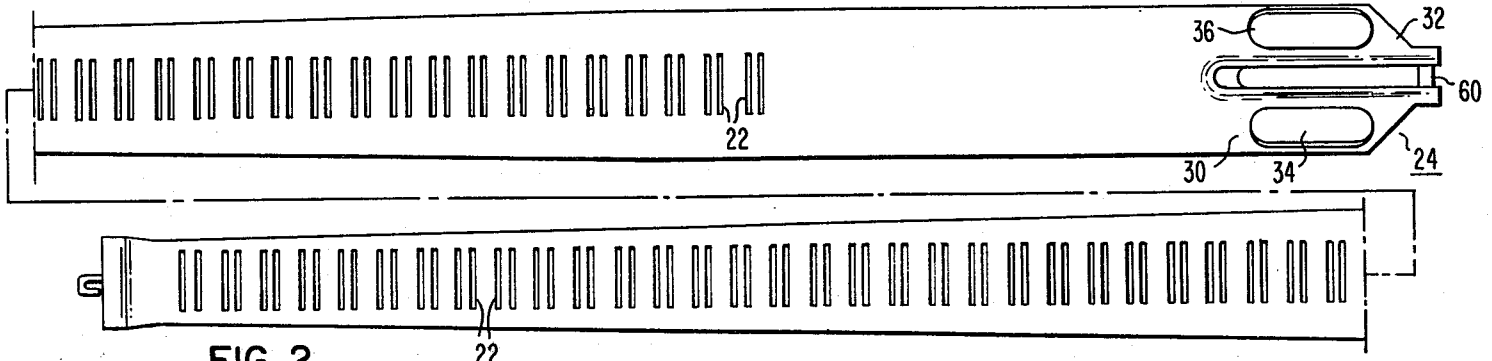
FIG. 2 is a plan view of the main portion of the burner of FIG. 1.
Figure 1:
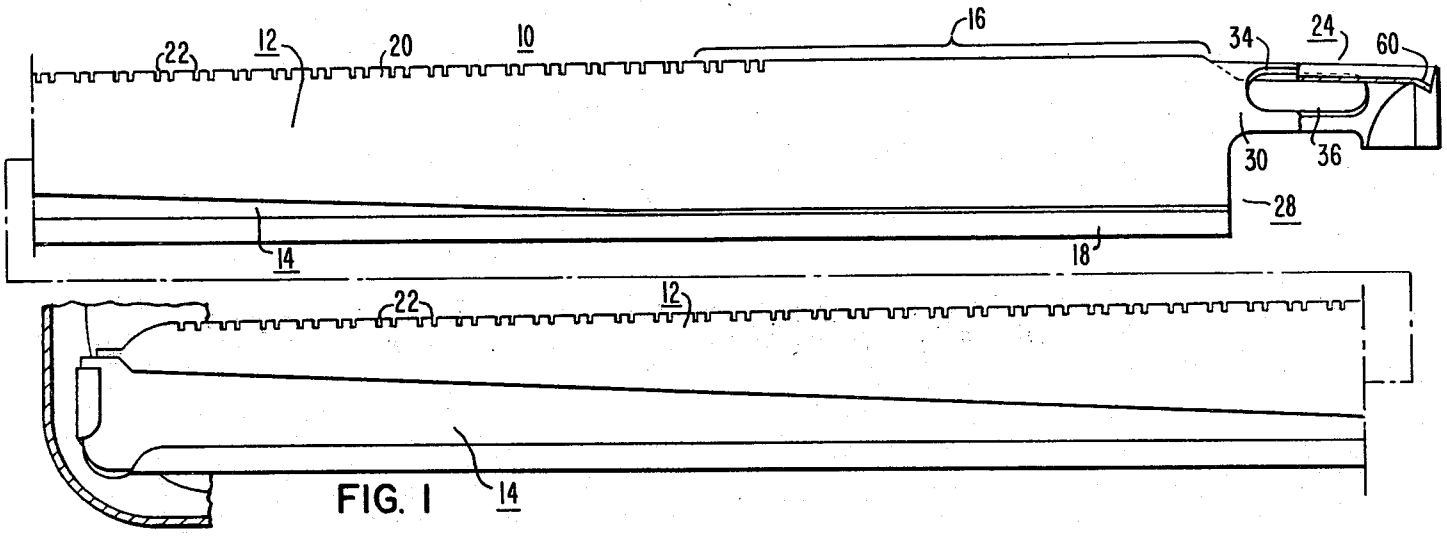
FIG. 1 is a side view of the main portion of a gas burner having an upstream end configuration according to the invention, this view also including a fragmentary portion of a heat exchanger envelope at the left showing the support arrangement for that end of the burner.
Figure 3:
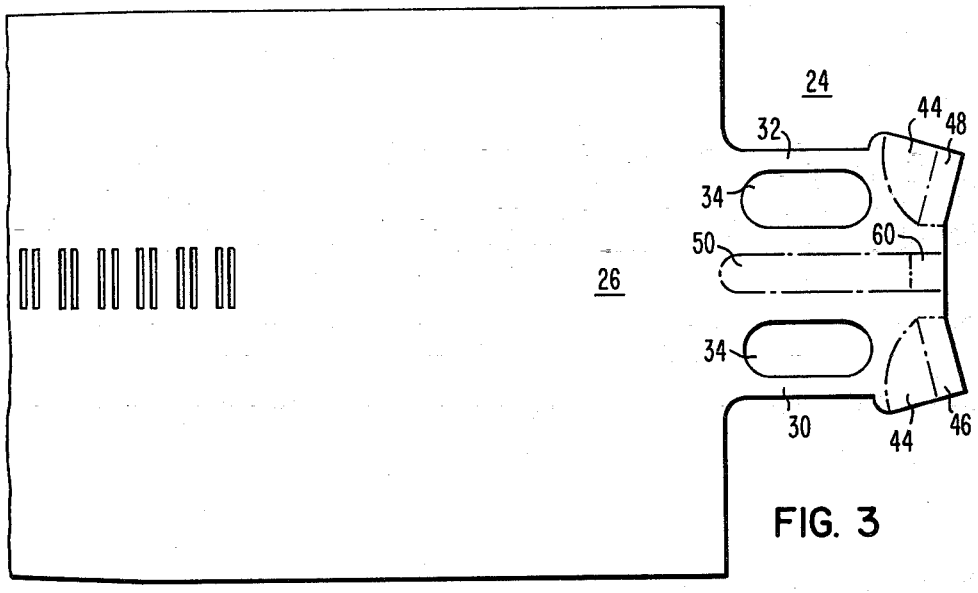
FIG. 3 is a plan view of a fragmentary portion of the gas burner main portion in the flat before forming and including the inlet end portion in its flat configuration.

The gas burner 10 shown in FIGS. 1 and 2 includes a hollow tubular portion generally designated 12 and an underlying rib portion designated 14 with the upstream minor portion of the length of the tubular portion indicated by the bracket 16 being of substantially uniform cylindrical shape with an underlying seam 18 of substantially uniform height and thickness. The tapered part 20 of the tube is provided with transverse slots 22 in the upper wall serving as gas ports. The arrangement thus far described is more fully described in the noted cross-referenced patent application and is the contribution of the inventive entity of that particular application. The burner, including the upstream end portion generally designated 24, is formed from a single, initially flat, metal sheet 26 (FIG. 3) as is also described in the noted cross-referenced application.

Turning now to the present invention, the shaped sheet metal part 24 (FIGS. 1 and 2) projects upstream from the air inlet end 28 of the main portion of the gas burner and is downwardly open from about the horizontal mid-plane of the air inlet end of the burner. If the part is considered in the sense of quadrants with respect to a transverse section therethrough, the lower quadrants are omitted through the metal removal operations with respect to the blank 26 of FIG. 3. As to the walls forming the upper quadrants of the part, wall 30 includes opening 34 and wall 32 includes an opening 36 for the admission of inlet air downwardly into the air inlet end 28 of the burner. Thus, there is provision for the admission of inlet air both through the entire downwardly open side of the part as well as from above through the openings 34 and 36.

Figure 4:
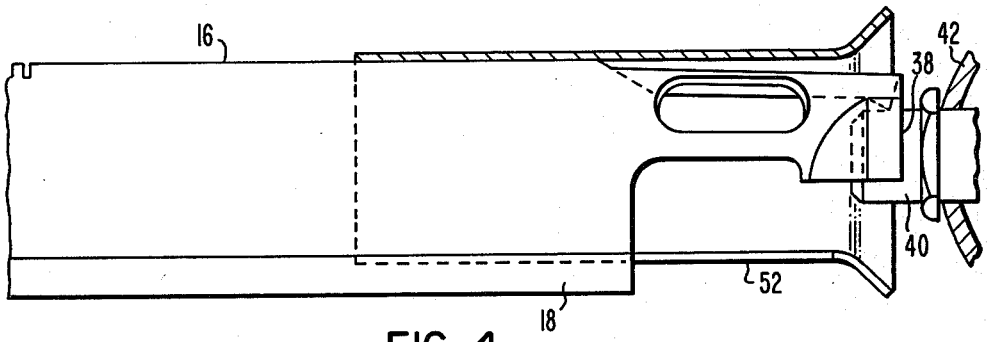
FIG. 4 is an enlarged side view, partly in section, of the upstream end of the main portion of the burner with an air shutter according to the invention in place and showing the general relationship of these parts to the gas manifold and a typical spud.
Figure 5:
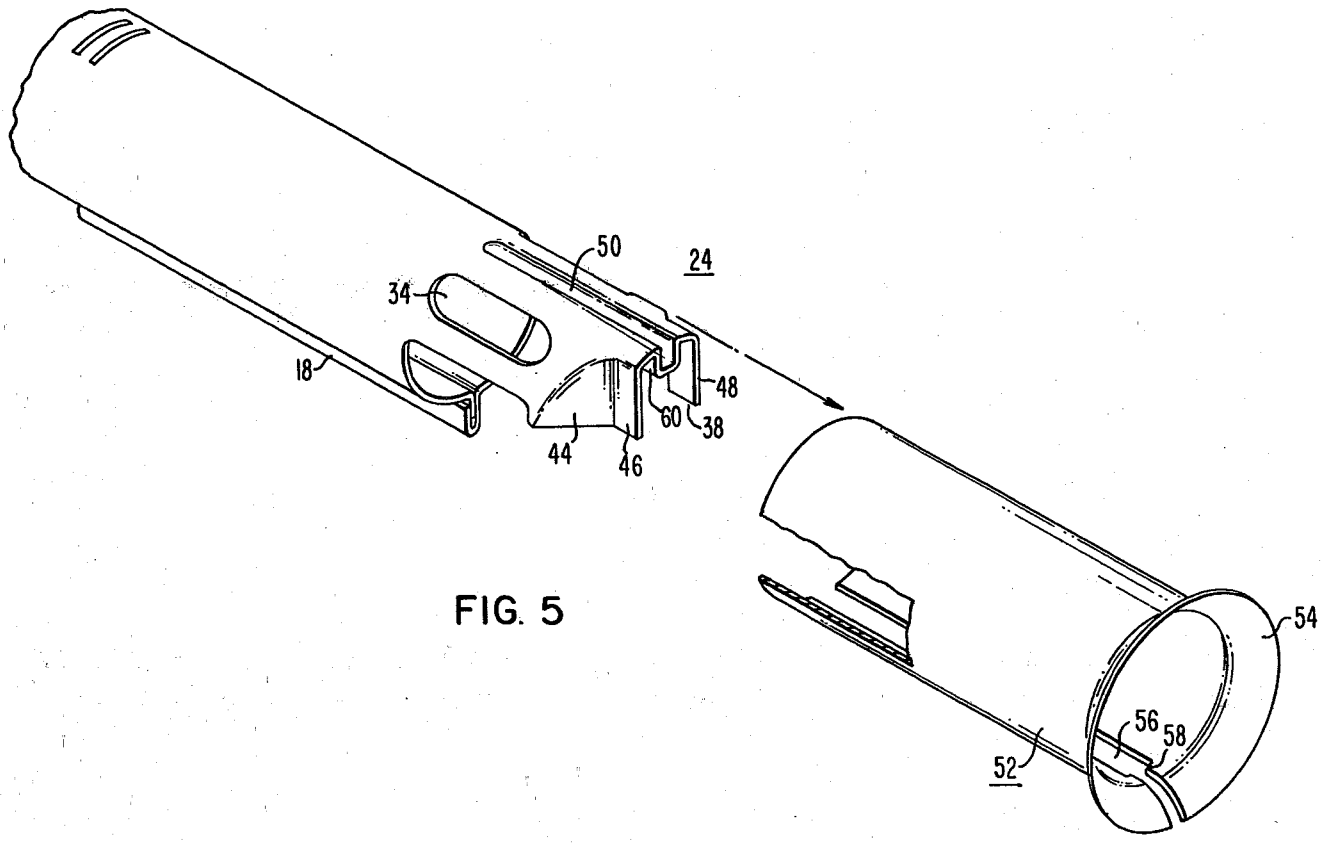
FIG. 5 is an exploded isometric view of the upstream end of the burner with the air shutter in separated relation.

The extreme upstream end of the part is crimped inwardly, as perhaps best seen in FIG. 5, to a degree to form a narrowed, downwardly-open saddle 38 (FIGS. 4 and 5), which is adapted to be received upon the outer circumference of a gas spud 40 projecting from the gas manifold pipe 42. In addition to forming a saddle 38 by the crimping operation, it also results in two opposite, generally diagonally-extending flats 44 adjacent the margins 46 and 48, which form the sides of the saddle. A longitudinally extending groove 50 is formed along the top of the sheet metal part. The areas on the flat piece of sheet metal which correspond to the numerically identified geometric configurations noted are identified by the same numerals in FIG. 3.

An air shutter generally designated 52 is shown in FIGS. 4 and 5 and comprises a generally cylindrical-shaped part throughout the major portion of its length and provided with a converging tube-shaped portion 54 at its upstream end and a longitudinally extending slot 56 at the bottom for the length of the shutter. The slot is provided to accommodate the seam 18 (FIGS. 4 and 5) at the bottom of the cylindrical portion 16 of the burner tube.

The shutter is provided with stop means adjacent its upstream end, the stop means in the currently preferred arrangement comprising a narrowing of the slot to form a shoulder 58 on one or both sides of the slot. Accordingly, as the shutter 52 is slipped onto the sheet metal part 24, which has a generally cylindrical shape and onto the upstream portion 16 of the burner tube the shoulder 58 will prevent moving the shutter beyond the end of the rib or seam 18.

A typical relation of the shutter 52 to the part 24 and the remainder of the burner is as shown in FIG. 4.

Some of the advantages of the arrangement may be more readily grasped by an explanation of some of the purposes of the particular features. By providing the openings 34 in the upper quadrant walls of the part 24 air can be admitted from a direction which overlies the obstructing manifold pipe 42, to mix with the air being admitted into the part from a direction below the pipe. The converging tube or funnel-shaped portion 54 of the air shutter minimizes turbulence and flow restrictions experienced with simple sharp-edged orifices. The axially adjustable shutter 52 is slid to the proper location to provide the proper amount of primary air in accordance with the type of gas and pressure thereof. In that connection, it is noted that the nozzle design and size of the gas spud differs with the type different of gas used. The nozzle changes are internal, however, with the spuds having the same outer diameter regardless of the type of gas. A low density gas such as natural gas will be provided with a larger internal diameter jet than a high density gas such as propane. It is also noted that the high density gases are injected at a much higher pressure than natural gas, and as a result the region within the burner where the injected gas and the primary air are mixed shifts in relation to the spud exit. Thus, it is distinctly advantageous that the funnel-shaped inlet be in a movable relation to the exit of the gas spud. The relocation of the air shutter also permits tuning out the resonance which most frequently occurs with the high density propane.

The groove 50 and its upstream end 60 perform several functions. The groove provides significant stiffening of the part 24 which lessens the likelihood of damage to the upstream part. Such damage can occur in handling in either the factory or in the field. In that connection it is noted that by virtue of making the burner from an originally flat piece of material, the material used can be relatively thinner than would be the case if a preformed tube were used, which typically is of a heavier gauge material. However, because of the lighter gauge material used in the invention the upstream part with the openings therein would, but for the stiffening by the groove, be more subject to misalignment because of damage. The depth of the groove at its upstream end 60 is designed, in accordance with the circumference of the spud 40, so that upon placing the end 60 down onto the spud the center line of the spud and of the burner are substantially axially aligned.

In the currently preferred arrangement the air shutter and part 24 are devoid of special means to maintain the position of the shutter relative to the end 24. However, the strips of material immediately below the openings 34 are bent outwardly slightly to create a frictional interference between these strips and the inside circumference of the shutter. This arrangement is expected to normally adequately maintain the position.

Figure 6:
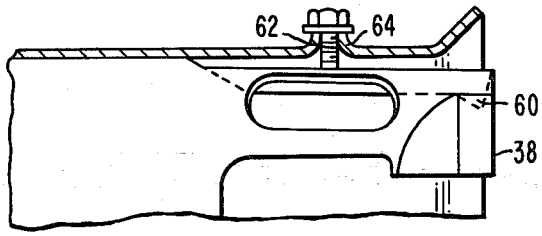
FIG. 6 is a sectional side view of a modified arrangement in which fastening means is provided for the shutter.

It is also within the contemplation of the invention that special means be provided to ensure that the relationship be maintained. In FIG. 6 an arrangement is shown in which a threaded fastener 62 is provided in a dimple 64 in the upper wall of the shutter, this fastener being located with respect to the circumference of the burner so that in its engagement with the burner the fastener descends into the groove 50. This arrangement is considered desirable because any disturbance of metal occurs down in the groove and so ease of subsequent adjustments is not affected.

The support of the closed end of the burner is conventional in that the end is supported in a niche in the envelope of the heat exchanger.

We claim:

1. In combination:

a one-piece gas burner member formed of a single, monolithic metal sheet, said member including a tubular portion with an upstream, generally open gas and primary air receiving end, an opposite closed end, and port means in the upper portion of a part of said tubular portion;

the upstream portion of said member being of generally cylindrical shape in cross section for at least a minor part of the length of said tubular portion and including at the upstream end of said upstream portion a shaped part which is downwardly open from about the horizontal mid-plane of said cylindrical shape, the upper quadrant walls of said shaped part including at least one opening therein for the admission of part of the inlet air to said member, said shaped part having a downwardly-open, saddle-shaped, upstream end adapted to be received on the circumference of a gas spud; and a primary air shutter of substantially uniform cylindrical shape throughout a major portion of its length and of a circumferential inner dimension to telescopically fit around said cylindrical shape of said upstream portion of said member and around said shaped part, said shutter having a converging tube-shaped entry at its upstream end through which primary air is admitted to said member, said shutter being longitudinally slidable to vary the admission of said primary air.

2. The combination of claim 1 wherein:

said shaped part includes a groove extending longitudinally therealong to provide stiffening for said part, and said groove at its upstream end has a depth dimension, relative to the diameter of said gas spud to substantially axially align in a vertical direction said burner member with the outlet of said spud.

3. For a tubular gas burner having an upstream end adapted to be supported from a gas spud projecting toward the burner from a gas manifold, an air admission and burner support arrangement comprising:

a shaped sheet metal part projecting upstream from the air inlet end of the gas burner, said part being downwardly open from about the horizontal mid-plane of the air inlet end of the burner, said part also being open at its upstream end, and having at least one opening in the walls forming each of the upper quadrants of the part for the admission of part of the inlet air downwardly into said air inlet end of said burner, the extreme upstream end of said quadrant walls having an inward crimp to form a narrow, downwardly open saddle adapted to be received on the outer circumference of said gas spud, said part including a groove extending longitudinally between said wall openings to stiffen said part, said groove at its upstream end having a depth dimension, relative to the diameter of the particular gas spud with which the burner is used, to substantially axially align in a vertical direction said burner member with the outlet of said spud.

4. An arrangement according to claim 3 wherein said shaped sheet metal part is monolithic with the sheet metal forming the gas burner.

* * * * *